US006560796B1

(12) United States Patent
Diforio

(10) Patent No.: US 6,560,796 B1
(45) Date of Patent: May 13, 2003

(54) BED SUPPORT SYSTEM AND METHOD

(76) Inventor: Carl J. Diforio, 1933-C Eastchester Dr., High Point, NC (US) 27265

( * ) Notice: Subject to any disclaimer, the term of this patent is extended or adjusted under 35 U.S.C. 154(b) by 53 days.

(21) Appl. No.: 09/708,949

(22) Filed: Nov. 9, 2000

Related U.S. Application Data

(60) Provisional application No. 60/164,743, filed on Nov. 12, 1999.

(51) Int. Cl.[7] ..... A47C 19/04

(52) U.S. Cl. ..... 5/200.1; 5/185; 5/202

(58) Field of Search ..... 5/200.1, 201, 202, 5/222, 224, 236.1, 240, 251, 282, 184, 185; 403/231, 230, 174, 217, 389, 385, 398

(56) References Cited

U.S. PATENT DOCUMENTS

| | | | | | |
|---|---|---|---|---|---|
| 587,864 | A | * | 8/1897 | Ryan et al. | |
| 674,725 | A | * | 5/1901 | Bergman et al. | |
| 819,631 | A | * | 5/1906 | Bollinger | |
| 934,607 | A | * | 9/1909 | Grenier | |
| 985,355 | A | * | 2/1911 | Lockhart | |
| 1,319,576 | A | * | 10/1919 | Durden | |
| 1,504,807 | A | * | 8/1924 | Brotherton, Jr. et al. | |
| 1,640,754 | A | * | 8/1927 | Covey | |
| 1,676,987 | A | * | 7/1928 | Line | |
| 1,716,243 | A | * | 6/1929 | Rooks | |
| 2,452,808 | A | * | 11/1948 | Tucker | |
| 2,550,224 | A | * | 4/1951 | Clerc | |
| 2,624,890 | A | * | 1/1953 | Rubinstein | |
| 2,666,931 | A | | 1/1954 | Clerc | |
| 2,674,749 | A | * | 4/1954 | Longnecker | |
| 2,886,832 | A | * | 5/1959 | Mitchell et al. | |
| 2,900,647 | A | * | 8/1959 | Sands | |
| 3,003,158 | A | * | 10/1961 | Sevcik | |
| 3,646,623 | A | * | 3/1972 | Harris et al. | |
| 3,736,602 | A | * | 6/1973 | Miller | |
| 3,744,066 | A | * | 7/1973 | Falivene | 5/176 |
| 3,761,970 | A | * | 10/1973 | Fredman | 5/181 |
| 3,881,202 | A | * | 5/1975 | Tyhanic | 5/176.1 |
| 3,984,884 | A | * | 10/1976 | Spitz | 5/202 |
| 3,999,231 | A | * | 12/1976 | Robins | 5/176 |
| 4,019,211 | A | * | 4/1977 | Spitz | 5/181 |
| 4,027,343 | A | * | 6/1977 | Hooker | |
| 4,038,710 | A | * | 8/1977 | Tambascio | 5/200 |
| 4,070,717 | A | * | 1/1978 | Kitchen et al. | 5/176 |
| 4,080,674 | A | | 3/1978 | Fredman et al. | |
| 5,815,860 | A | * | 10/1998 | Mitchell | 5/236 |
| 5,894,614 | A | | 4/1999 | Stroud | |
| 5,996,145 | A | * | 12/1999 | Taylor | 5/184 |
| 6,289,535 | B1 | | 9/2001 | Hernandez | |

OTHER PUBLICATIONS

Leggett & Platt Steel Products Division Branch Price List eff. Date Jan. 30, 1995.*

K31 Assembly Instructions—undated.*

* cited by examiner

*Primary Examiner*—Lynne H. Browne
*Assistant Examiner*—Fredrick Conley

(57) ABSTRACT

An adjustable bed support system and method provides comfort and security when positioned in a typical bed frame. The support system also has an adjustable leg to help maintain the support system when the mattress and/or box springs are fully loaded. The bed support system can be adjusted for various width and height beds and can be easily removed and positioned in another bed frame having a different width as necessary.

16 Claims, 4 Drawing Sheets

BED SUPPORT SYSTEM AND METHOD

Priority benefit is claimed under §119(e) of provisional application No. 60/164,743 filed Nov. 12, 1999.

FIELD OF THE INVENTION

The present invention pertains to a system for supporting mattresses and box springs on bed frames, and particular pertains to a support system which is uniquely adjustable to fit different width and height bed frames.

DESCRIPTION OF THE PRIOR ART AND OBJECTIVES OF THE INVENTION

Various types and configurations of adjustable mattress and box spring supports have long been known and used in the furniture industry. U.S. Pat. Nos. 1,319,576; 1,640,754; 2,886,832; 4,038,710 and 5,815,860 all illustrate support systems which in some instances replace conventional wooden slats for holding mattresses and box springs within a bed frame. While several of the prior art devices provide lateral adjustment, certain ones are relatively weak and may sag when used with wide beds such as queen, king or larger beds. Also, some of the prior art bed support systems are difficult and complicated to adjust while others cannot be easily manufactured or installed.

Thus, with the problems and disadvantages of prior art bed support systems, the present invention was conceived and one of its objectives is to provide a box spring and/or mattress support for a conventional bed frame which utilizes two laterally extending rectangular, longitudinal, tubular members.

It is still another objective of the present invention to provide a support system which includes a central bracket having an adjustable leg depending therefrom for height adjustment.

It is still another objective of the present invention to provide an adjustable bed support system which includes a pair of collars surrounding the longitudinal members which provide rigidity and integrity thereto.

It is a further objective of the present invention to provide a bed support system and method which can be easily manufactured and installed by relatively unskilled persons.

Various other objectives and advantages of the present invention will become apparent to those skilled in the art as a more detailed description is set forth below.

SUMMARY OF THE INVENTION

The aforesaid and other objectives are realized by providing a support system and method utilizing longitudinal members such as mild steel rectangular tubes which are slidably contained within a central bracket. The method presented allows the tubular longitudinal members each to be extended from the central bracket and locked into place by set screws thereon. Once locked into place an adjustable leg which is affixed to a central bracket is dropped or extended to the floor below. When the floor is contacted, set screws contained within the leg are tightened to provide a rigid structure for holding the box spring and mattress securely in place, which assists in preventing sagging.

DETAILED DESCRIPTION OF THE PREFERRED EMBODIMENTS AND OPERATION OF THE INVENTION

Figure 1:
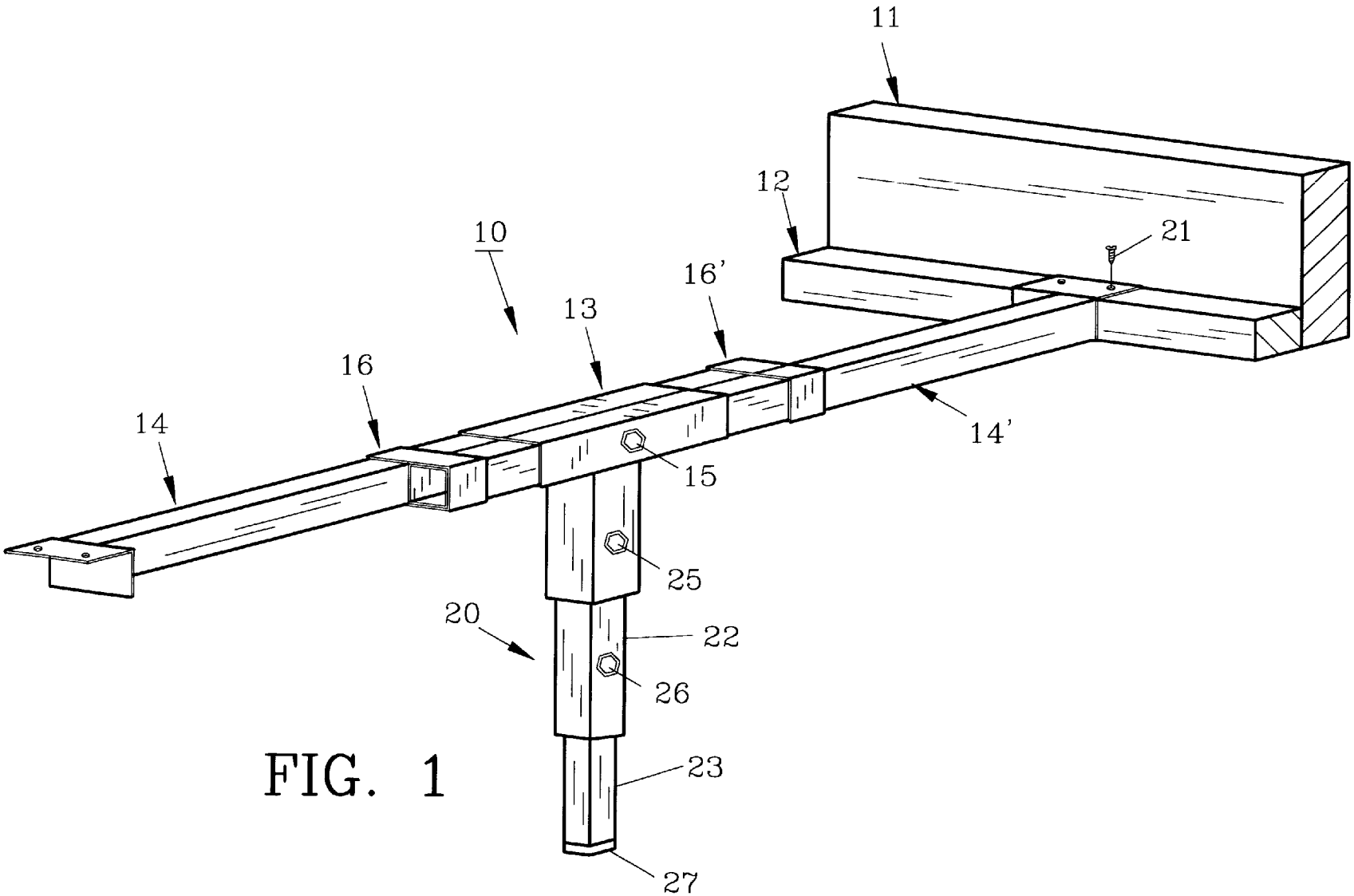
FIG. 1 illustrates the bed support system of the invention in schematic, lateral relation with a bed rail section.

For a better understanding of the invention and its operation, turning now to the drawings, FIG. 1 illustrates preferred bed support system 10 as may be used on a queen size or other bed as illustrated with a typical wooden bed side rail section 11. As seen, side rail 11 has mattress flange 12 affixed thereto. Support system 10 includes a central bracket 13 formed from two rectangular, tubular members which have been joined, such as by welding or the like. Longitudinal members 14, 14' are slidably contained within central bracket 13 and can freely move back and forth as needed in parallel alignment for adjustment to a particular bed frame width. When suitably adjusted, alien type set screws 15, and 17 (FIG. 2) which act as locking members, are tightened, thereby locking longitudinal members 14, 14' into central bracket 13 and preventing further slidable motion. Collars 16, 16' also seen in FIG. 1 help support and stabilize system 10. Rectangular collar 16 at one end of central bracket 13 is rigidly affixed to the terminal end of longitudinal member 14' and slidably contains longitudinal member 14, whereas rectangular collar 16' at the opposite end of central bracket 13 is rigidly affixed to the terminal end of longitudinal member 14 also such as by welding or the like and slidably contains longitudinal member 14'.

Leg 20 (FIG. 1) is rigidly affixed to central bracket 13 such as by welding and is adjustable vertically as sections 22 and 23 telescope and can be locked into place by respectively, set screws 25, 26. Plastic end cap 27 positioned at the terminal end of section 23 prevents marring of hardwood floors or other surfaces.

Figure 2:
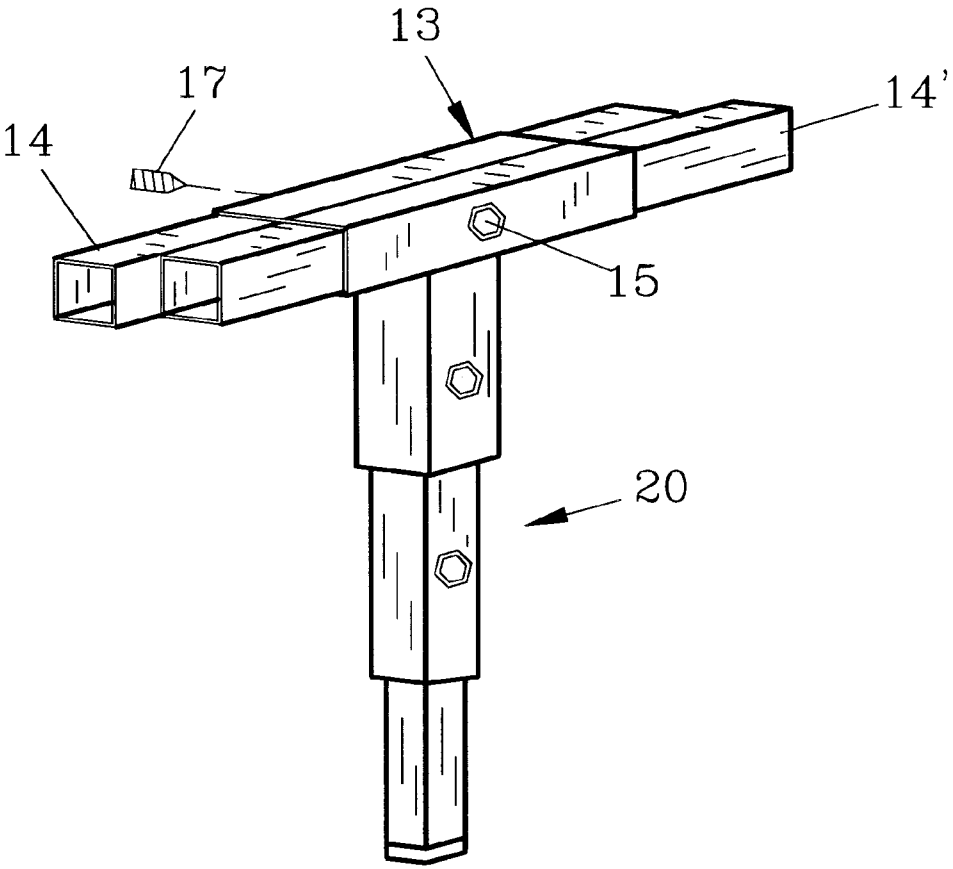
FIG. 2 depicts a partial abbreviated view of the bed support system.

In FIG. 2, longitudinal member 14, 14' have been fragmented to illustrate their tubular nature and may be formed of suitable aluminum, steel or other materials. Set screw 17 is seen removed from central bracket 13 for illustrative purposes.

Figure 3:
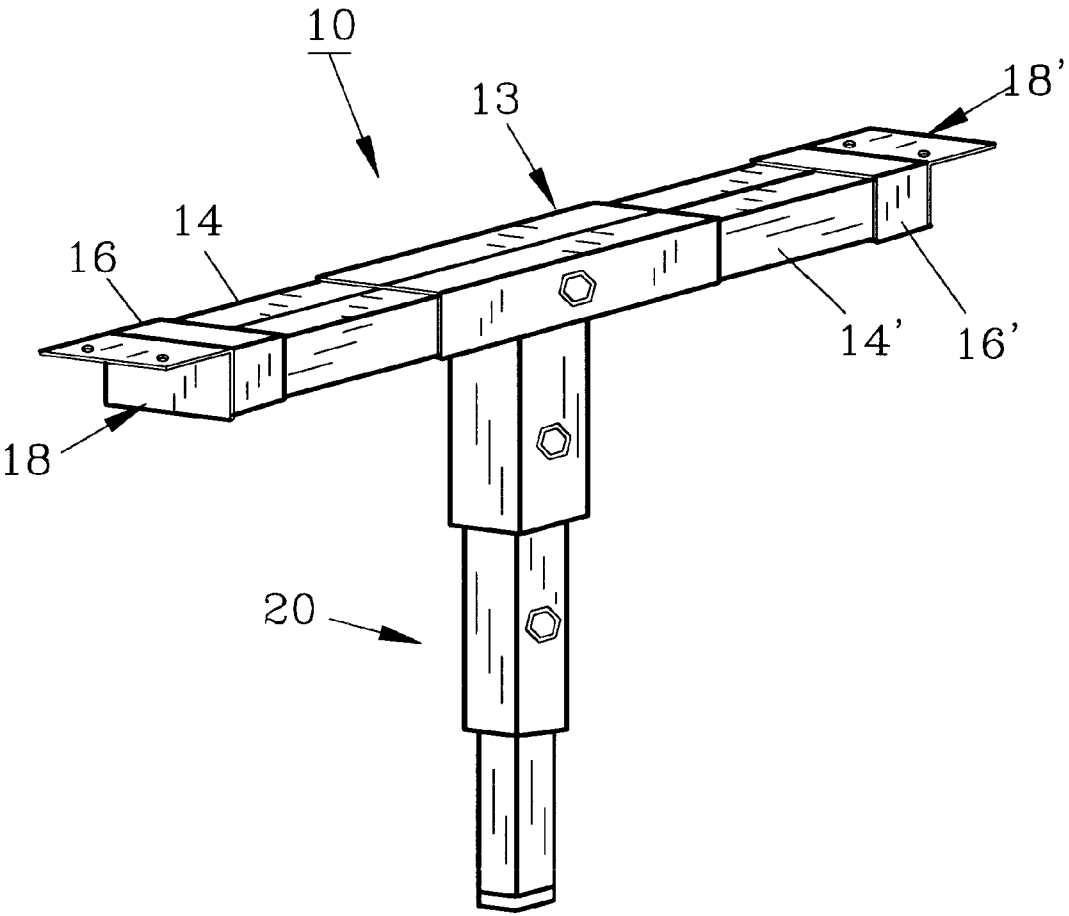
FIG. 3 demonstrates the bed support system removed from a bed frame and in a collapsed or closed posture but with the leg extended.
Figure 4:
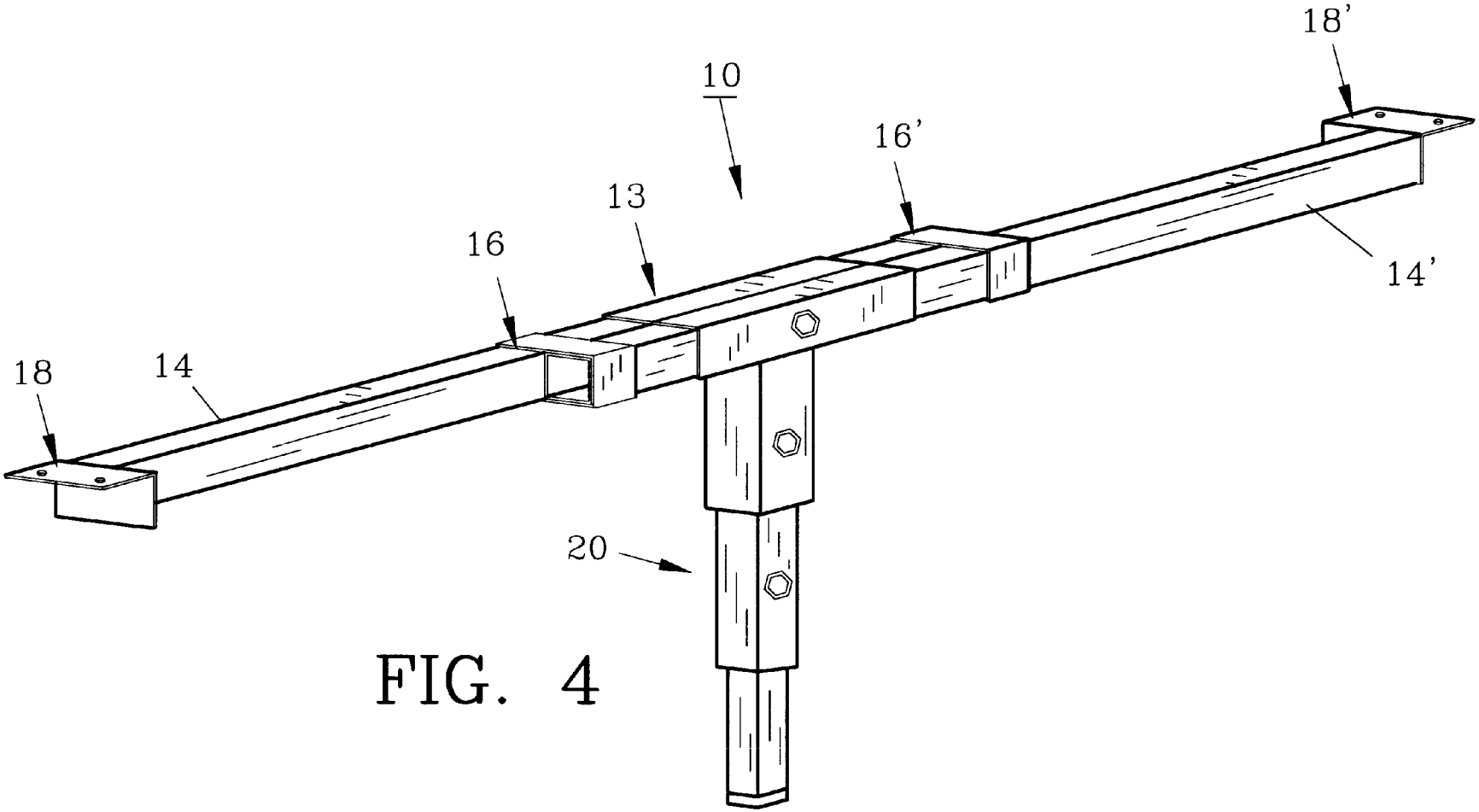
FIG. 4 pictures the bed support system as removed from a bed but with the longitudinal members laterally extended.

In FIG. 3 support system 10 is shown in a collapsed or closed posture with collars 16, 16' abutting respectively, cleats 18, 18' as would be required for a single or narrow bed frame. Other cleats or ends may be used or configured for longitudinal members 14, 14'. In FIG. 4, longitudinal members 14, 14' are shown in a more extended posture for example, for placement or use with a queen size bed.

As would be further understood, one or more support systems 10 may be used in a bed frame in parallel, spaced relation for supporting mattresses, box springs or the like, with the exact number depending on the length and degree of support deemed desirable.

The preferred method of supporting a mattress or box spring on a bed utilizing the support system 10 includes placing support system 10 laterally on a bed frame, between the side rails thereof. Next, longitudinal members 14, 14' are slid in opposite directions through central bracket 13 until cleats 18, 18' abut or otherwise contact the opposing bed side rails such as flange 12 of side rail section 11 as shown in FIG. 1. Cleats 18, 18' will contact the bed side rails and thereafter set screws 15, 17 are tightened, to act as locking members to prevent further sliding of longitudinal members 14, 14' within central bracket 13. Next, attaching means such as screws 21, seen in FIG. 1 affix the cleats to the bed side rails. While a standard screw 21 is illustrated, other types of attaching means may be employed such as a bolts, adhesives, Velcro® or the like. Once support system 10 has been so affixed to the bed side rails, leg 20 is adjusted by loosening and thereafter tightening locking set screws 25, 26. Set screws 25, 26 are loosened to allow leg sections 22, 23 to drop downwardly until plastic end cap 27 contacts the floor (not shown) below.

Other types of beds, bed side rails and cleats can be used and designed whether for wooden or metal bed frames and side rails as desired by those skilled in the art. Also other types of locking members other than standard set screws can be used such as pins, latches, bolts or other fasteners. Thus, the illustrations and examples provided herein are for explanatory purposes and are not intended to limit the scope of the appended claims.

I claim:

1. A support system for a bed comprising:

a first longitudinal member, a second longitudinal member, a central bracket, said first and said second longitudinal members extending completely through said central bracket in parallel alignment, said central bracket slidably containing said first and said second longitudinal members, a first collar, said first collar rigidly attached to said first longitudinal member at one end of said central bracket and slidably containing said second longitudinal member.

2. The support system of claim 1 further comprising a first locking member, said first locking member positioned on said central bracket to terminate the sliding motion of said first sliding member.

3. The support system of claim 2 further comprising a second locking member, said second locking member positioned on said central bracket for terminating the sliding motion of said second longitudinal member.

4. The support system of claim 2 wherein said first locking member comprises a set screw.

5. The support system of claim 1 further comprising a second collar, said second collar rigidly attached to said second longitudinal member along the end of said central bracket opposite said first collar, said second collar slidably containing said first longitudinal member.

6. The support system of claim 1 further comprising a leg, said leg affixed to said central bracket.

7. The support system of claim 6 wherein said leg is adjustable.

8. The support system of claim 1 further comprising a cleat, said cleat affixed to said first longitudinal member.

9. The support system of claim 8 further comprising an attaching means, said attaching means positioned on said cleat.

10. The support system of claim 9 wherein said attaching means comprises a threaded member.

11. A method of supporting a mattress on a bed frame utilizing a support system having a central bracket which slidably contains first and second longitudinal members each having collars rigidly attached at different ends of the central bracket, said support system also having locking members and an adjustable leg comprising the steps of:

a) placing the support system on a bed frame;

b) sliding the longitudinal members in parallel through the central bracket to contact the sides of the bed frame; and c) adjusting the leg length.

12. The method of claim 11 wherein the placing the support system on a bed frame comprises the step of placing the support system laterally on the bed frame.

13. The method of claim 11 wherein sliding the longitudinal member comprises the step of locking the longitudinal member to the central bracket to prevent further sliding movement.

14. The method of claim 11 wherein adjusting the leg comprises allowing the leg to drop down from the central bracket.

15. The method of claim 11 wherein sliding the longitudinal members comprises the step of sliding the longitudinal members each through collars rigidly attached to the other said longitudinal member.

16. A support system for a bed comprising: a first longitudinal member, a second longitudinal member, a central bracket, said first and said second longitudinal members extending completely through said central bracket in parallel alignment, a first collar, said first collar rigidly attached to said first longitudinal member at one end of said central bracket, said first collar slidably containing said second longitudinal member, a second collar, said second collar rigidly attached to said second longitudinal member at the other end of said central bracket, said second collar slidably containing said first longitudinal member whereby said first and second longitudinal members can be extended from said central bracket for adjustment to a particular bed frame.

* * * * *